United States Patent [19]

McMahon

[11] Patent Number: 5,000,064

[45] Date of Patent: Mar. 19, 1991

[54] MAGNETIC TACKING HAMMER HANDLE

[76] Inventor: James P. McMahon, 1116 Gilbert St., Hayward, Calif. 94541

[21] Appl. No.: 384,548

[22] Filed: Jul. 24, 1989

[51] Int. Cl.[5] ..... B25D 1/06

[52] U.S. Cl. ..... 81/24

[58] Field of Search ..... 81/23, 24, 26

[56] References Cited

U.S. PATENT DOCUMENTS

| | | | |
|---|---|---|---|
| 84,351 | 11/1868 | Green | 81/23 |
| 710,615 | 10/1902 | Robertson . | |
| 1,441,903 | 1/1923 | Balaziuk . | |
| 1,664,594 | 4/1928 | Cummings . | |
| 2,385,859 | 10/1945 | Jacobson | 175/367 |
| 2,597,876 | 5/1952 | Kurkjian . | |
| 2,671,483 | 3/1953 | Clark . | |
| 3,228,720 | 1/1966 | Jordan | 294/65.5 |

*Primary Examiner*—James G. Smith

*Attorney, Agent, or Firm*—Kathleen A. Skinner

[57] ABSTRACT

A hammer with a nonmagnetic handle has a head on one end of the handle and a magnet permanently embedded in a lower end portion of the handle opposite the head. The magnet is disposed in a plane transverse to the longitudinal axis of the handle. The magnet has an outer end disposed on the surface of the handle so that a nail will be held perpendicular to the longitudinal axis of the handle and it can be lightly tapped into a work surface by a person gripping the hammer proximate its head.

2 Claims, 1 Drawing Sheet

MAGNETIC TACKING HAMMER HANDLE

BACKGROUND OF THE INVENTION

1. Field of the Invention

The present invention relates to the field of tools and more particularly to a magnetic tacking hammer handle.

2. Description of the Prior Art

In the course of construction work for example in nailing sheetrock in place, it is sometimes necessary to tack a nail in place before driving it permanently into the work surface. This is particularly important when nailing into elevated surfaces and places where it is difficult to reach to hold the nail in place with one hand while pounding it in with a hammer held in the other hand.

A number of tools in the prior art have utilized magnetic means to hold the nail in position until it can be tacked into place. In many of these tacking tools, the magnetic means is included in the head of the hammer. To tack the nail in place the hammers shown in U.S. Pat. Nos. 2,597,876 and 2,671,483, for example, would be swung with the same motion as that used to drive the nail in permanently. Some of these hammers have magnets to hold the nail in place along the longitudinal axis of the hammer handle (e.g., U.S. Pat. No. 710,615) and require a thrusting motion to tack the nail. U.S. Pat. No. 1,664,594 has a pivoting member to hold the nail physically in place until the hammer head, used in a sideways manner, can start the nail.

However, a magnet which is located in the hammer head can eventually become demagnetized by the regular use of the hammer in striking nails. Moreover, it is not easy to be accurate in tacking a nail when holding the hammer by its handle and extending the heavier head end to the end of one's reach.

Although some hammers or other tools have used magnets in the handle end, the magnets have been used to attract nails from aprons or pick up other metal objects, as described in U.S. Pat. Nos. 3,228,720 and 1,441,903. When used for this purpose, the magnet protrudes from the bottom of the handle along the longitudinal axis of the handle. Neither of these latter prior art devices would be useful for tacking purposes, however, since the magnetic protrusions would make it difficult to line up the nail accurately and the thrusting longitudinal motion necessary to tack the nail in would be less precise than the normal motion of swinging a hammer.

Thus, there has been a need in the construction field for a hammer or other tool having a permanent magnet located in the tool so that it is not readily demagnetized and so that the hammer can be used to precisely anchor a nail for tacking purposes without awkward movements by the user. In addition, there has been a need for a hammer handle which allows the hammer to be utilized for both standard pounding and tacking functions and which could be easily manufactured from standard parts. The present invention provides a hammer handle which is a solution to the problems and disadvantages of these prior art devices.

SUMMARY OF THE INVENTION

The present invention is an improved tacking hammer handle which has a magnet permanently embedded in the lower end of the handle. The magnet is disposed in a plane generally transverse to the longitudinal axis of the handle so that the magnetic pole in the outer end of the magnet will hold a nail at right angles to the longitudinal axis of the handle. By gripping the hammer securely proximate its head, a person may extend his or her reach and accurately tap a nail into a work surface.

Thus, it is an object of this invention to provide a magnetic hammer which can be used to hold a nail or the like in place against a work surface and to lightly tap it into place before driving it in. It is another object of this invention to provide a hammer with magnetic means which would avoid or reduce the demagnetization effects which can result in a hammer in which a magnet is located close to the hammer head. It is also an object of the invention to provide a magnetic hammer which can be relatively easily manufactured with standard parts and used with relative accuracy.

Other objects and advantages of the invention will become apparent when it is considered in conjunction with the accompanying drawings described hereafter.

DESCRIPTION OF THE PREFERRED EMBODIMENT

The present invention is a magnetic tacking hammer handle which has magnetic means for holding a nail in place so that it can be lightly tapped into the work surface and its position will be held prior to being driven into the surface in a conventional manner.

Figure 1:
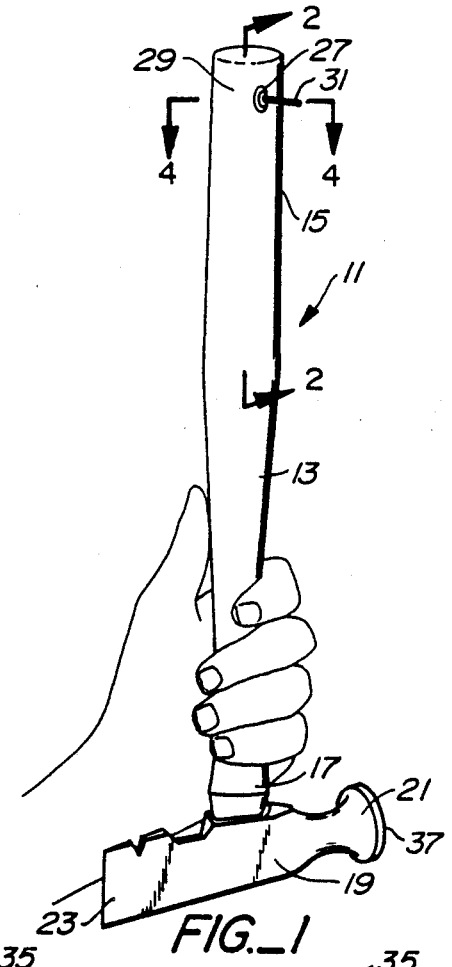
FIG. 1 is a perspective view of the magnetic tacking hammer handle of this invention showing a nail magnetically held in position for tacking.

The invention employs a hammer 11 which has a handle 13 of any convenient length. The handle has a lower end portion 15 and an upper end portion 17 to which is attached a head 19. The head may have any configuration useful for general or specialized purposes and it will usually have a pounding end 21 and a claw end 23. For example, a hammer with a head adapted for use in hanging drywall is illustrated in FIG. 1. The head, which will usually be constructed of metal, is attached to a handle 13 in any known manner. The handle may be made from wood, plastic, fiberglass or other suitable material and it may be any suitable length. The handle of the preferred embodiment of this invention, or at least its lower end 15, is constructed from a non-magnetic material. The cross-sectional shape of the handle is not critical to the invention and it may be elliptical, rectangular, circular or any other shape, although it is obviously desirable to employ a shape for the handle which is comfortable and can be easily gripped when the hammer is used in its conventional striking position.

A magnet 25 is permanently embedded in the lower end portion 15 of the hammer handle 13. The magnet is disposed in a plane generally transverse to the longitudinal axis of the handle. The magnet has an outer end 27 which contains a magnetic pole and is disposed proximate the external surface 29 of the handle whereby a nail 31 may be held against the outer end of the magnet at right angles to the longitudinal axis of the handle and lightly tapped into a work surface by a person gripping the hammer proximate its head 19. The hammer 11 may be gripped by placing one's fingers around the upper end 17 of the handle, as illustrated in FIG. 1, or by placing one's fingers around the head 19 itself with the handle protruding between the fingers. In either case, the pounding action necessary to tack in the nail will employ the same wrist and arm action that is customary for the worker when using the hammer in its conventional manner. However, he will not have to balance the weight of the hammer head at the end of his full reach while tapping in the nail.

The magnet 25 will be disposed in a recess 33 in the handle 13. This recess is located in a plane transverse to the longitudinal axis of the handle. The recess may be in the form of a bore disposed through the handle, extending from one surface 29 of the handle through to the opposite surface 30 on the other side of the handle. The recess may be formed by drilling a hole in the handle of a conventional hammer in a plane generally perpendicular to the longitudinal axis of the handle. The hole is in the lower end of the handle generally near its bottom surface 35 and it may be sized to fit the magnet selected. The recess could also be created by providing for a recess in the mold of a plastic handle or by other known means.

The magnet 25 will preferably be shaped to correspond to the shape of the recess 33. The surface of the outer end 27 of the magnet 25 is substantially flat and oriented to align the head of a nail 31. When the magnet is disposed in a handle 13 having a relatively flat external surface 27 near the magnet, the magnet's outer surface will be substantially flush with the surface 29 of the handle. In the preferred embodiment, the magnet is cylindrical in shape to fit snugly in the bore in the handle. The magnet is permanently affixed in the handle so that it cannot fall out or become loose during its tacking function. The hammer 11 of this invention is effective for tacking nails if the magnet has an outer end disposed proximate one surface of the hammer handle. However, in one variation of the invention, the recess in the handle and the magnet fitted therein preferably extend across the entire width of the hammer handle from one external surface 29 to the opposite surface 30. Both outer ends 27 and 28 of the magnet will then be available for use.

Accordingly, this invention may be constructed by adapting a standard hammer, such as a drywall hammer, by drilling a bore into the handle 13 in its lower end 15, perhaps 178 inch to 1 inch (1.27 to 2.54 cm.) from the bottom surface 35. It is desirable for clearance purposes that the magnet 25 be as close as practical to the bottom of the handle so that the end of the handle will not damage surrounding surfaces when tacking near corners or ceilings, for instance. The bore 33 will be generally parallel to the bottom surface and preferably will go through to the other side of the handle. In a conventional hammer, surface 29 and 30 of the handle are roughly parallel to the sides of the hammer head which extend from its pounding end 21 to its claw 23. In embodiments having a recess with a single opening, it is desirable for the recess to open on either surface 29 or 30; for embodiments with a bore extending through to both surfaces it is desirable for the bore to extend between surfaces 29 and 30, so that the outer surface of the magnet will be disposed transverse to the pounding surface 37 of the hammer head 21. The nail will thus be oriented perpendicularly to the head and one may conveniently grip the head when using the hammer's tacking end without the claw or pounding end interfering with one's hand.

A conventional magnet, such as an Alnico bar magnet, is then pressed into the recess and permanently affixed therein by adhesive or epoxy so that it will not be worked free with use. It has been found that an Alnico magnet $\frac{3}{8}''$ in diameter can be affixed by epoxy in a bore of the same diameter and that it will be retained satisfactorily.

Figure 4:
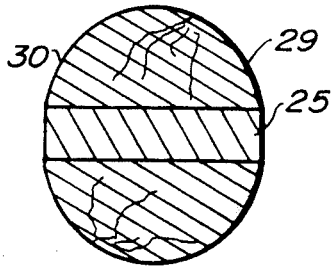
FIG. 4 is a cross-sectional view of the lower end of the hammer handle of FIG. 1, taken along line 4—4 of FIG. 1 and FIG. 2.
Figure 4A:
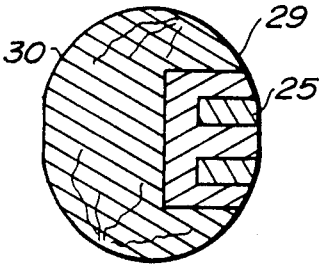
FIG. 4A is a cross-sectional view corresponding to section 4—4 of FIG. 1 of the lower end of the hammer handle of the alternative embodiment shown in FIG. 2A.
Figure 2:
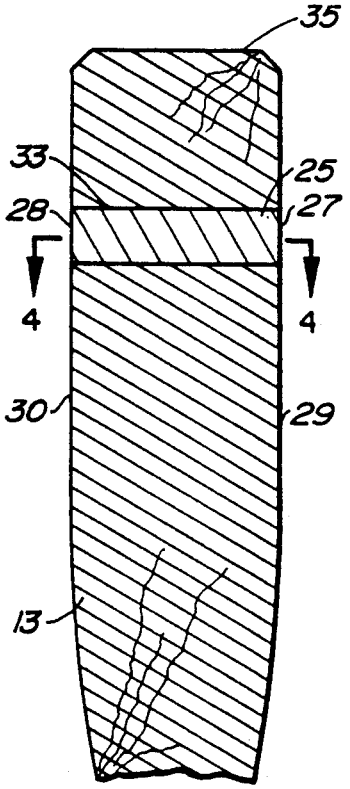
FIG. 2 is a cross-sectional view of the lower end of the handle taken along line 2—2 of FIG. 1.
Figure 2A:
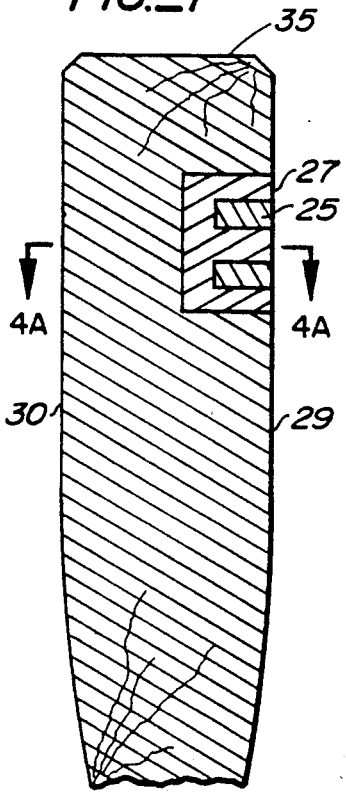
FIG. 2A is a cross-sectional view of the lower end of a hammer handle of an alternative embodiment, corresponding to the section 2—2 shown in FIG. 1.
Figure 3:
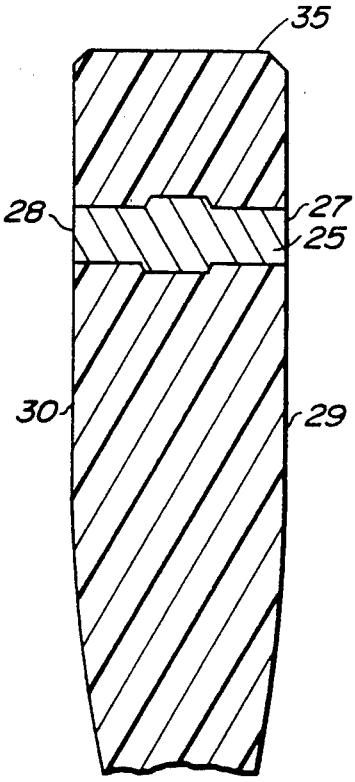
FIG. 3 is a cross-sectional view of an alternative embodiment of the hammer handle of this invention corresponding to the section 2—2 shown in FIG. 1.

Alternatively, magnets and recesses of different shapes could be employed and the shapes used could be the primary or additional means for affixing the magnet; for instance, the magnet shown in FIG. 3 would be anchored by its flared or protruding portion from breaking free. A pot magnet, which is cylindrical and has concentric poles separated by nonconductive material and which is illustrated in FIGS. 2A and 4A, could also be used to provide an even stronger magnetic force.

The outer end surface 27 (or each surface 27, 28) of the magnet is then ground to match the contour of the handle 13 to present a relatively flat surface for aligning the head of the nail to go straight into the work. The magnet may obviously be any size but it should be large enough to exercise an effective magnetic force on the nail and not so large as to jeopardize the integrity of the handle or make manufacturing difficult.

Thus, the hammer of this invention can be manufactured relatively easily from standard materials, if desired, with magnetic means on one or more sides of the hammer handle. The tacking means is conveniently located in the same hammer which is used to complete the job. In use, a rail is placed against the outer end of the magnet, the hammer is gripped by its head or near its head and it is swung lightly to tap the pointed end of the nail into the work surface without the need for another hand to hold the nail. The hammer is then reversed and the handle gripped in a conventional manner and the nail is driven in as usual. In both the tacking and driving actions, the hammer is swung with the same motion with which the worker is already comfortable and competent. Thus, this invention provides a hammer handle which allows the hammer to be used for both tacking and pounding functions and it provides a magnetic tacking means in a hammer so that the striking action will not demagnetize the magnet. The hammer of this invention is also advantageously balanced for tacking because of the location and orientation of the magnet. Thus, a nail can be easily tacked in the work surface straight with only one hand and the worker using it can be more efficient and accurate.

It will be seen that the above-described tacking hammer provides these advantages over the prior art, and while it has been described in detail, it is not to be limited to such details, except as may be necessary by the appended claims.

I claim:

1. In a hammer having a handle of nonmagnetic material with a lower end portion and a head attached to an end of said handle opposite said lower end portion, the improvement comprising a handle having a bore in the lower end of said handle disposed therethrough in a plane transverse to the longitudinal axis of said handle, said bore extending from one surface of said handle through to the opposite surface thereof; and a magnet disposed in said bore and permanently embedded in said handle, said magnet having outer ends disposed on opposite surfaces of said hammer handle whereby a nail may be held against the outer end of said magnet at right angles to the longitudinal axis of said handle and lightly tapped into a work surface by a person gripping the hammer proximate its head.

2. The hammer of claim 1 wherein the magnet has a shape corresponding to the shape of the bore and the surface of at least one outer end of said magnet is substantially flat to align a nail perpendicular to the longitudinal axis of the handle.

* * * * *